US006543356B2

(12) United States Patent
Göttling et al.

(10) Patent No.: US 6,543,356 B2
(45) Date of Patent: Apr. 8, 2003

(54) CYLINDER IN EQUIPMENT FOR PRODUCING PRINTING PLATES

(75) Inventors: Josef Göttling, Friedberg (DE); Godber Petersen, Augsburg (DE); Robert Kersch, Dasing (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 09/747,244

(22) Filed: Dec. 21, 2000

(65) Prior Publication Data

US 2001/0006025 A1 Jul. 5, 2001

(30) Foreign Application Priority Data

Dec. 22, 1999 (DE) ..... 199 61 868

(51) Int. Cl.[7] ..... B41C 1/10
(52) U.S. Cl. ..... 101/248; 101/463.1
(58) Field of Search ..... 101/494, 463.1, 101/216, 248

(56) References Cited

U.S. PATENT DOCUMENTS

| | | | | |
|---|---|---|---|---|
| 2,460,504 A | | 2/1949 | Huebner | 101/479 |
| 2,925,037 A | | 2/1960 | Fischer | 101/216 |
| 2,986,997 A | | 6/1961 | Schmutz | 101/248 |
| 4,414,898 A | | 11/1983 | Westerkamp et al. | 101/248 |
| 4,901,641 A | | 2/1990 | Steiner et al. | 101/152 |
| 4,920,627 A | * | 5/1990 | Aikins et al. | 29/402.08 |
| 5,547,448 A | * | 8/1996 | Robertson | 492/16 |
| 5,819,658 A | | 10/1998 | Bornhorst, Jr. | 101/407.1 |
| 5,829,159 A | * | 11/1998 | Hodgins et al. | 34/121 |
| 5,960,714 A | | 10/1999 | Göttling et al. | 101/216 |
| 6,186,065 B1 | * | 2/2001 | Kersch et al. | 101/212 |

FOREIGN PATENT DOCUMENTS

| | | |
|---|---|---|
| DE | 355 111 | 6/1922 |
| DE | 934 371 | 10/1955 |
| DE | 1 983 546 | 4/1968 |
| DE | 197 22 460 | 2/1999 |
| DE | 197 40 129 | 3/1999 |
| EP | 051 793 | 5/1982 |
| FR | 1 135 716 | 5/1957 |
| GB | 23 27 252 | 1/1999 |
| JP | 10-193556 | 7/1998 |

* cited by examiner

*Primary Examiner*—Daniel J. Colilla
(74) *Attorney, Agent, or Firm*—Cohen, Pontani, Lieberman & Pavane

(57) ABSTRACT

A cylinder in equipment for making printing plates is provided which allows exposure of a cylinder that is mounted on both sides to be detached at a point of separation on a via side opposite its drive, a journal can be detached. The cylinder is driven by a blocking device capable of being fitted to a screw element which screws the journal to the cylinder and vice versa.

7 Claims, 6 Drawing Sheets

CYLINDER IN EQUIPMENT FOR PRODUCING PRINTING PLATES

BACKGROUND OF THE INVENTION

1. Field of the Invention

The present invention relates to a cylinder in equipment for making printing plates, which is mounted in a frame by its journals by means of bearings and can be exposed on one side.

2. Description of the Related Art

U.S. Pat. No. 2,925,037 discloses an intaglio plate cylinder which is mounted in side walls on both sides and can be exposed on one side by creating an opening. The opening in the side wall is created by one bearing being pulled off the journal and being pivoted away together with a piece of the wall. The bearing is seated with a tapered sleeve on an external taper of the journal and is screwed to the journal by means of a screw element. In order to be able to pull off the bearing, the screw element must first be loosened manually by means of a tool. Conversely, following introduction of the plate cylinder into the machine frame, the bearing has to be screwed manually to the journal.

SUMMARY OF THE INVENTION

The object of the present invention is to provide a cylinder in which the manual effort required on assembly to expose one side of the cylinder is reduced.

The drive movement of the cylinder is used to tighten or to loosen a screw element by means of which a journal can be screwed to the cylinder. During the screwing operation, a blocking device holds the screw element firmly. As a result, a journal can be screwed onto or off the cylinder without any need for tools, nor any application of manual effort, and the cylinder can be exposed quickly on one side.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views, the present invention is described in schematic form as follows.

DETAILED DESCRIPTION OF THE PRESENTLY PREFERRED EMBODIMENTS

Figure 1:
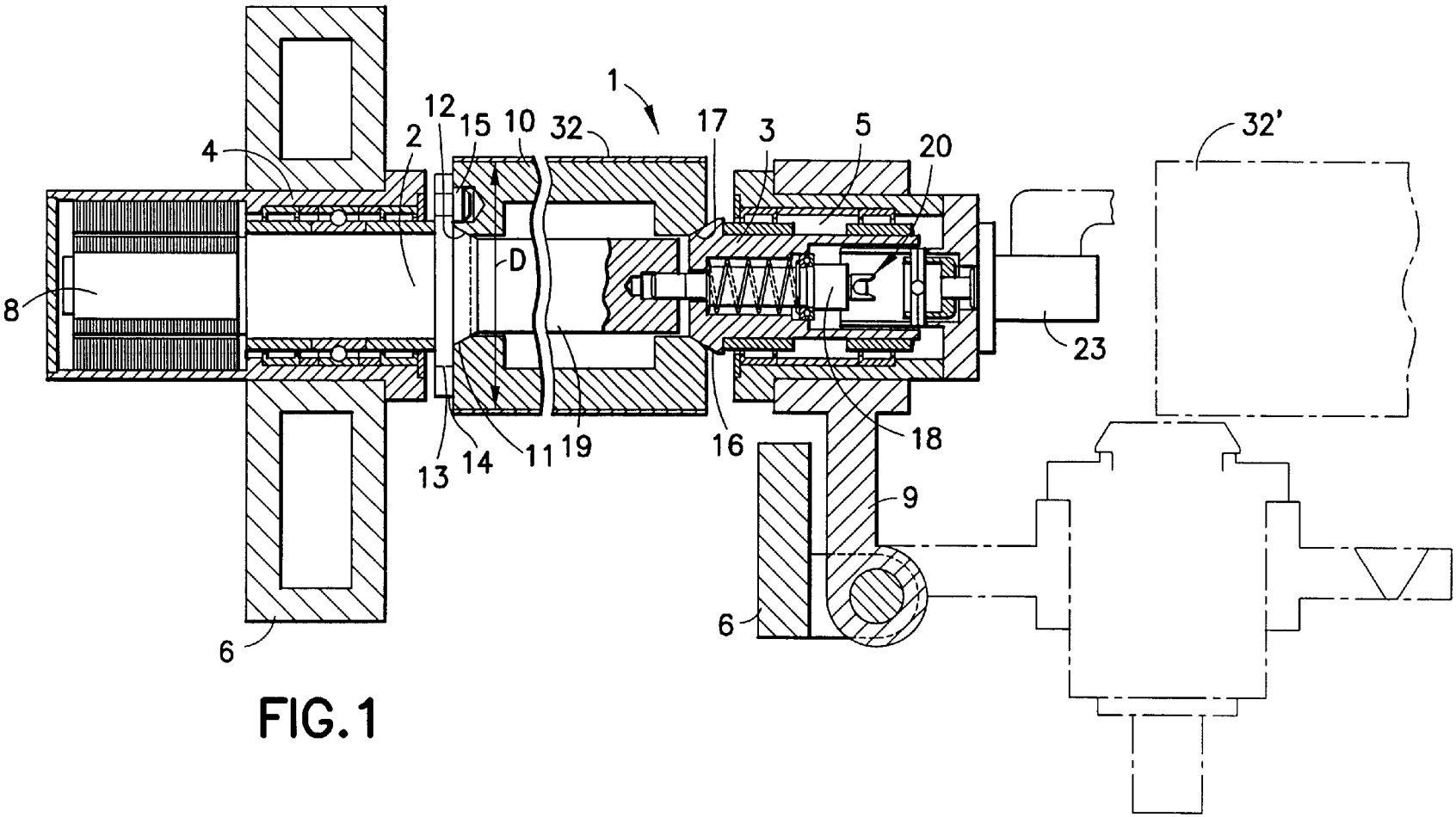
FIG. 1 shows a cylinder according to the present invention having its own drive motor and a journal which can be pivoted away together with a bearing block.

Referring now to FIG. 1, a cylinder in equipment for producing printing plates, which is mounted in a frame 6 by its journals 2, 3 by means of bearings 4, 5 is shown. A motor 8 such as, for example, an electric motor is arranged on the first journal 2. The second journal 3, together with its bearing 5, is accommodated in a bearing block 9, which is fixed to the frame 6 such that it can be pivoted. Alternatively, the bearing block 9 together with the second journal 3 can also be moved transversely relative to the longitudinal axis of the cylinder 1. Configurations of the second journal 3 and bearing block 9 and embodiments illustrating this mobility are disclosed in German Patent Application No. 199 61 867.4 herein incorporated by reference in its entirety. For example, German Patent Application No. 199 61 867.4 discloses a bearing block 9 may be in the form of a bearing housing which can also be moved on the frame 6.

The cylinder 1 contains a body 10, which is flange mounted on the first journal 2. In this case, the cylinder 1 is fitted by means of a pair of tapers, with an external taper 11 on the first journal 2 and an internal taper 12 on the body 10. In addition, the body 10 is screwed onto the flange 14 by means of screws 13. This screw fixing can also be omitted if the force fitting connection between the first journal 2 and the body 10 is ensured by adequately prestressing the pair of tapers 11, 12. This connection can also be made in a form fitting manner by means of a face dog or peg 15.

Figure 1A:
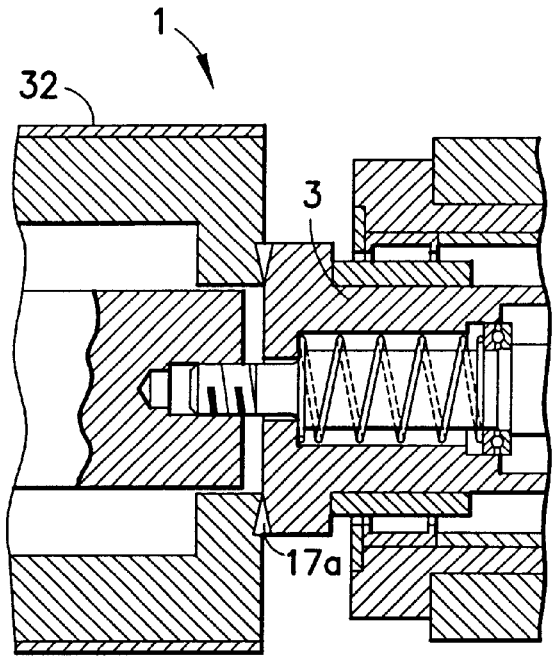
FIG. 1A is a detailed view of a section of the journal from FIG. 1 according to another embodiment of the present invention.
Figure 1B:
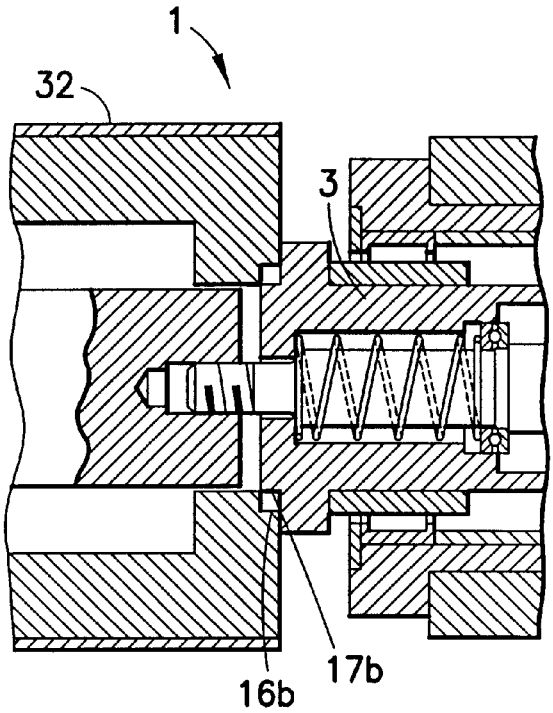
FIG. 1B is a detailed view of a section of the journal as in FIG. 1A according to yet another embodiment of the present invention.

The second journal 3 is detachably connected to the cylinder 1, the point of separation being designed as a pair of tapers with an external taper 16 on the second journal 3 and an internal taper 17 on the body 10 of the cylinder 1. Alternatively, the external and internal tapers 16, 17 could also be assigned to the components in the converse manner, i.e., with the external taper 16 being on the body 10 of the cylinder 1 and the internal taper 17 being on the second journal 3. The second journal 3 is screwed onto the cylinder 1, pairing up the external and internal tapers 16, 17 on the cylinder 1, by means of a screw element 18. Since the body 10 of the cylinder 1 can be separated form the first journal 2, the screw element 18 is screwed into an extension 19 of the first journal 2. The second journal 3 and the cylinder 1 can also have a Hirth toothing system 17*a* (See FIG. 1*a*) or a fit with external and internal diameter areas 16*b*, 17*b* (See FIG. 1*b*) at their point of separation.

Figure 2:
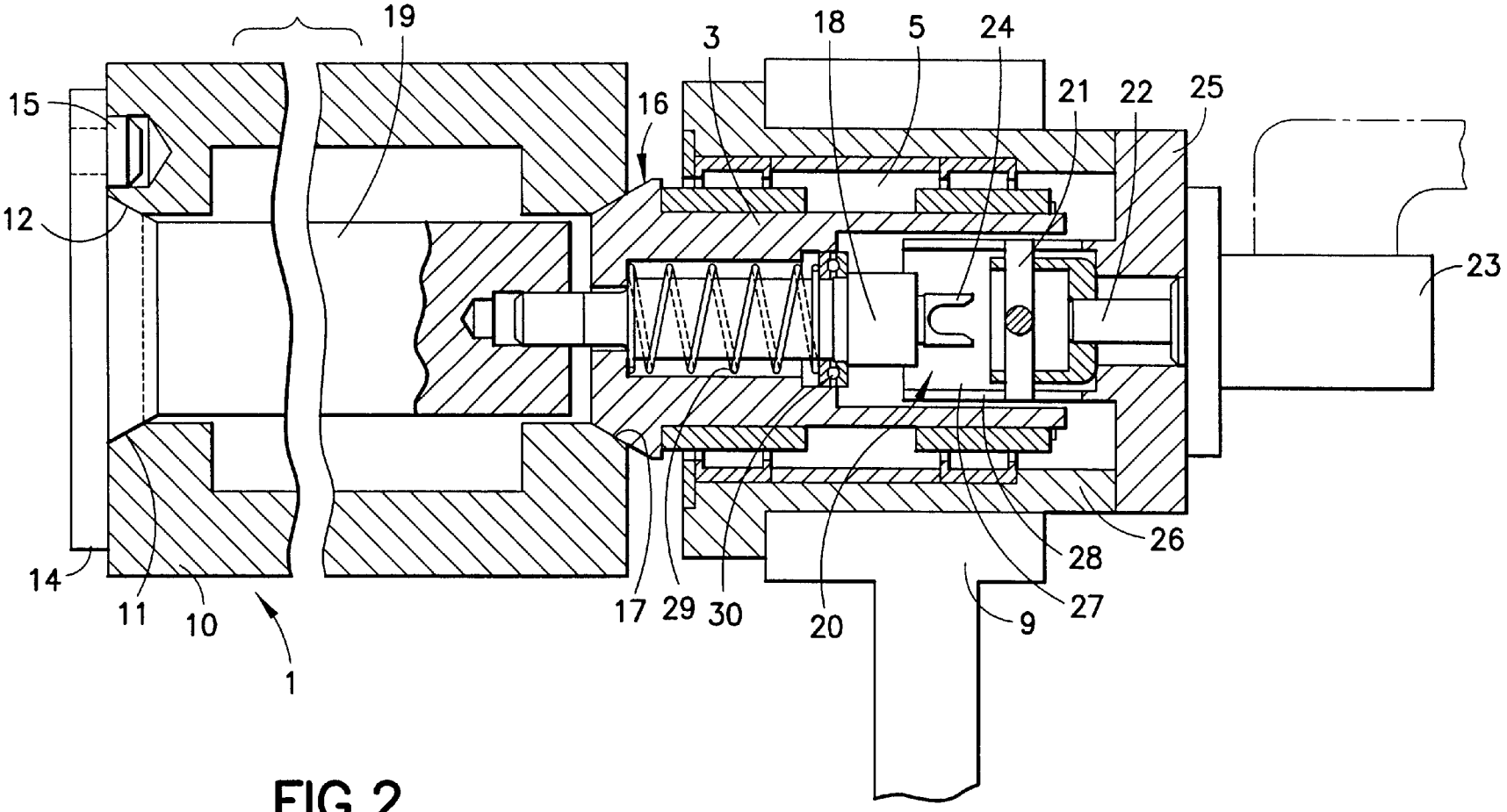
FIG. 2 is an enlarged view of the journal according to FIG. 1.

Referring now to FIG. 2, a detailed view of an embodiment of the present invention is shown. A blocking device 20, including a claw coupling, is arranged on the second journal 3. Its first, non-rotatable coupling part 21 is fixed to a piston rod 22 of a pneumatic working cylinder 23, while a second coupling part 24 is arranged on the screw element 18. In a preferred embodiment, the first coupling part 21, designed as a pin, is shown being rotated into the plane of the drawing. The second coupling part 24 is constructed as a claw. The working cylinder 23 is arranged on a closure cover 25 of a bush 26 of the bearing 5. A hollow pin 27 belonging to the closure cover 25 has slots 28 which extend in the axial direction of the second journal 3 and into which the first coupling part 21 (pin) is guided. Instead of the working cylinder, other actuating elements may be used, such as an electromagnet, to whose armature the first coupling part 21 is fixed.

Figure 3:
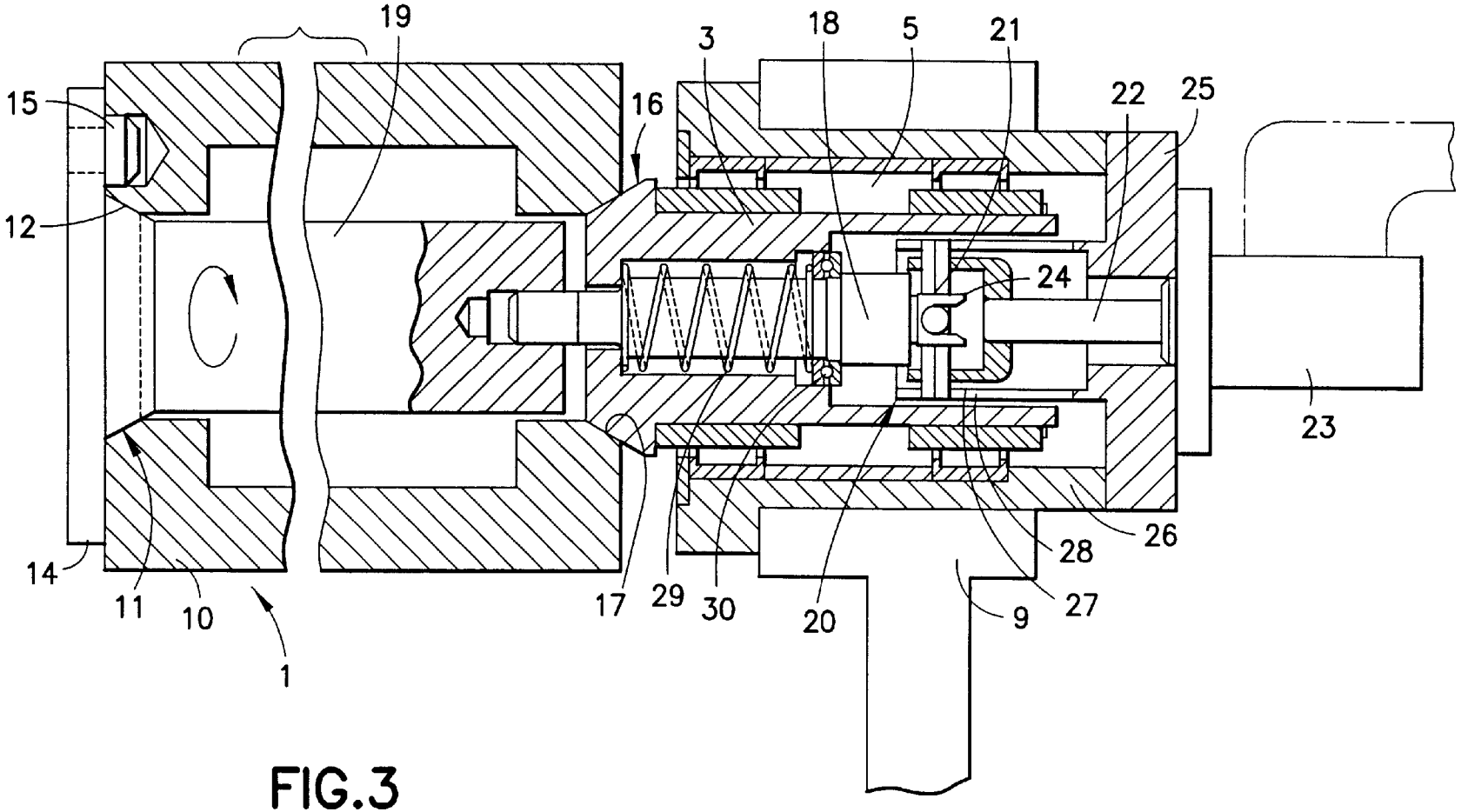
FIG. 3 shows the journal according to FIG. 2 with a blocking device coupled to the screw element.

Referring now to FIG. 3, exposure of the cylinder 1 at the second journal 3 is shown. The piston rod 22 of the pneumatic working cylinder 23 is extended, in other words, is changed over under control reversing the action of the working cylinder 23. As this is done, the claw coupling of the blocking device 20 is coupled by the first coupling part 21 entering the second coupling part 24. Since the first coupling part 21 is non-rotatably guided in the slots 28, it blocks the screw element 18 against rotation when it enters the second coupling part 24. If the cylinder 1 then continues to be driven in the direction R1 by means of the motor 8, the extension 19 rotates with respect to the stationary screw element, with the screw element 18 being screwed out of the extension 19. In the process, the piston rod 22 moves back counter to the pressure of the compressed air to the extent to which the screw element 18 is screwed out of the extension 19.

Figure 4:
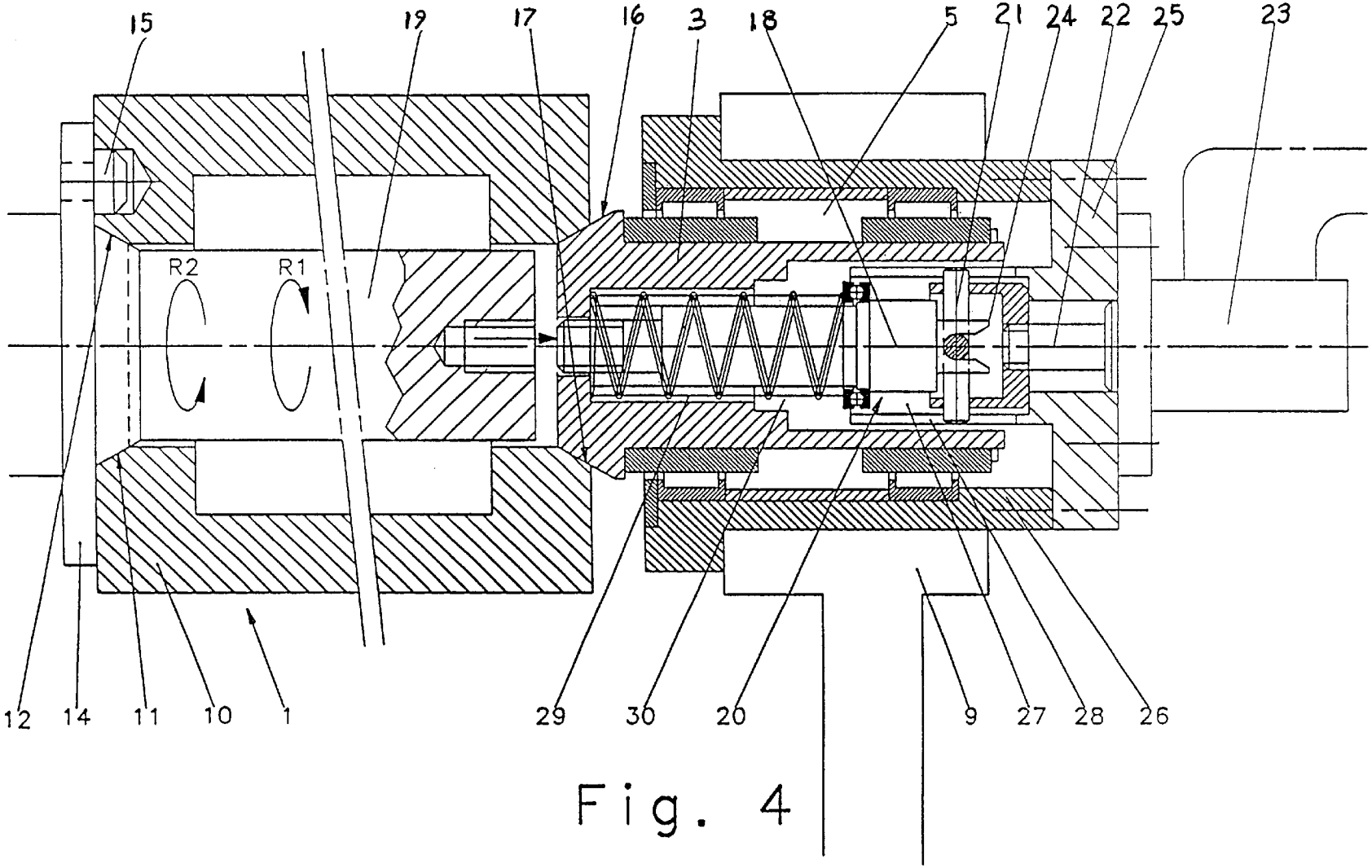
FIG. 4 shows the journal according to FIG. 2 with the screw element screwed out of the cylinder.

Referring now to FIG. 4, the position of the pneumatic working cylinder 23, is shown where the pneumatic working cylinder 23 is changed over under control after the screw element 18 has been screwed completely out of the extension 19. While the working cylinder is moving to this position, a spring 29 which is supported on the screw element 18, guides the screw element with it and pulls it away from the cylinder 1. The spring 29 is supported on the screw element 18 via an axial bearing 30 so that when the screw element 18 is stationary and the second journal 3 is rotating, the spring 29 does not tighten or jam.

After the screw element 18 has been unscrewed from the cylinder 1, the second journal 3, together with its bearing 5 and the bearing block 9, can be pivoted into the position shown as a dash-dotted line in FIG. 1. At the same time, the cylinder 1 is exposed on this side. A printing plate sleeve 32 can then be removed from the cylinder 1. The removed sleeve 32' is illustrated dash-dotted line in FIG. 1. It is also possible to remove the entire body 10 of the cylinder 1 from the equipment.

The subsequent assembly of the second journal 3 is performed in the reverse sequence to that of the previously described disassembly. Therefore, first the second journal 3 together with its bearing 5 and the bearing block are folded upwards into the position shown in FIG. 1. The pneumatic working cylinder 23 is then reversed, bringing the screw element 18 to rest with its threaded portion on the extension 19. Then, by driving the cylinder 1 in the direction R2 by means of the motor 8, the screw element 18 is screwed into the cylinder 1 (into the extension 19) and braces the second journal 3 against the body 10 and the body 10 against the first journal 2 at the respective tapered seats. Here, the torque of the motor 8 is selected such that a force fitting connection between the journals 2, 3 and the body 10 is provided. After the screw element 18 has been screwed in, the motor 8 is switched off and the pneumatic working cylinder 23 is then moved out of the way, so that it assumes the position shown in FIG. 1 and FIG. 2. The cylinder 1 can then fulfill its envisaged function.

Figure 5:
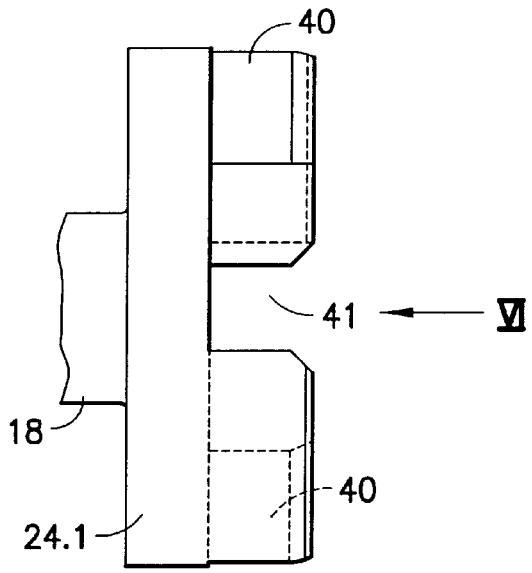
FIG. 5 shows a further embodiment of a coupling part of the blocking device included in FIGS. 1 to 4.

Another embodiment of the present invention is shown in FIG. 5 with respect to a second coupling part 24. In this embodiment, the second coupling part 24.1 has claws 40, with a gap 41 between adjacent claws 40, such that the first coupling part 21.1, which can be moved into these gaps 41, and the second coupling part 24.1, can be rotated through about 90° with respect to each other. Larger or smaller angles of rotation can also be provided.

Figure 6:
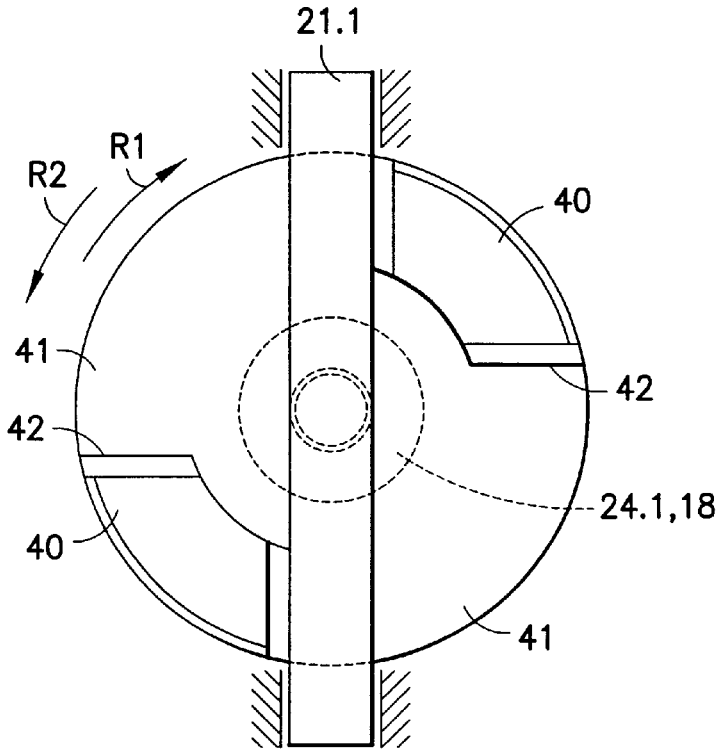
FIG. 6 shows the view VI from FIG. 5.

Referring now to FIG. 6, the embodiment of FIG. 5 is shown with the second coupling part 24.1 with the first coupling part 21.1 moved in between adjacent claws 40. During the rotation of the cylinder 1 in the direction R2, the screw element 18 fixed to the second coupling part 24.1 is screwed into the cylinder 1 with its threaded pin, the second journal 3 being screwed onto the cylinder 1 in the manner already described. In order to detach the journal 3 from the cylinder 1, the cylinder 1 is rotated in the direction R1 in the manner already described. Due the freedom of rotational between the second coupling part 24.1 and the first coupling part 21.1, the cylinder 1 initially rotates by the angle of the degree of rotational freedom (shown as 90° in this case). Then, the flanks 42 of the claws 40 encounter the stationary first coupling part 21.1. The shock which is caused creates a high torque on the screw element 18 overcoming its adhesive frictional moment (detaching moment) so that the screw element 18 unscrewed during the further rotation of the cylinder 1 in the direction R1. Due to this shock moment, even a very firmly seated screw element 18 can be reliably unscrewed.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A cylinder assembly for making printing plates, comprising:

a frame;

a first bearing and a second bearing arranged on the frame;

a cylinder having a first end and a second end;

a first journal interposed between the first end and the first bearing for mounting said first end relative to said first bearing;

a second journal interposed between the second end and the second bearing at a point of separation for mounting said second end relative to said second bearing;

a drive mounted on the frame and acting on the first journal so as to rotate the cylinder;

a screw element arranged in the second journal for connecting the second journal to the cylinder at the point of separation;

a blocking device selectively movable between a coupled position and an uncoupled position, wherein said blocking device is adapted for blocking rotation of the screw element when the blocking device is in the coupled position and thereby effecting longitudinal movement of the screw element relative to the cylinder during a screwing movement of the driven cylinder; and an actuating element fixed to the blocking device, wherein the blocking device includes a claw coupling having a first coupling part with a non-rotatable claw and a second coupling part, the first coupling part and the second coupling part are configured to have a freedom of rotation of about 90° when coupled to one another, and the actuating element serves to couple the first coupling part to the second coupling part.

2. The cylinder assembly according to claim 1, wherein said actuating element comprises a pneumatic working cylinder having a piston rod and being fixed to the first coupling part by the piston rod, the working cylinder being capable of moving the first coupling part into the second coupling part.

3. The cylinder assembly according to claim 1, wherein the second coupling part has a plurality of claws with a plurality of gaps between the claws allowing a rotation of the second coupling part with respect to the first coupling part.

4. The cylinder assembly according to claim 1, wherein the point of separation is defined by an external taper on one of the cylinder and the second journal and an internal taper on the other of the cylinder and the second journal.

5. The cylinder assembly according to claim 1, wherein the point of separation is defined by a toothing system on the cylinder and the second journal.

6. The cylinder assembly according to claim 1, wherein the point of separation includes a fit including a plurality of external diameter areas and a plurality of internal diameter areas on the cylinder and the second journal.

7. The cylinder assembly according to claim 1, wherein the drive is an electric motor.

* * * * *